US010677004B2

(12) United States Patent
Boyd et al.

(10) Patent No.: US 10,677,004 B2
(45) Date of Patent: Jun. 9, 2020

(54) RISER WITH INTERNAL ROTATING FLOW CONTROL DEVICE

(71) Applicant: WEATHERFORD TECHNOLOGY HOLDINGS, LLC, Houston, TX (US)

(72) Inventors: Michael Boyd, Nisku (CA); Serg Arabsky, Beaumont (CA); Andrew Barabash, Edmonton (CA)

(73) Assignee: Weatherford Technology Holdings, LLC, Houston, TX (US)

( * ) Notice: Subject to any disclaimer, the term of this patent is extended or adjusted under 35 U.S.C. 154(b) by 256 days.

(21) Appl. No.: 15/315,944

(22) PCT Filed: Jun. 9, 2015

(86) PCT No.: PCT/CA2015/050527
§ 371 (c)(1),
(2) Date: Dec. 2, 2016

(87) PCT Pub. No.: WO2015/188269
PCT Pub. Date: Dec. 17, 2015

(65) Prior Publication Data

US 2017/0101837 A1 Apr. 13, 2017

Related U.S. Application Data

(60) Provisional application No. 62/009,501, filed on Jun. 9, 2014.

(51) Int. Cl.
*E21B 23/01* (2006.01)
*E21B 33/08* (2006.01)
(Continued)

(52) U.S. Cl.
CPC ..... *E21B 23/01* (2013.01); *E21B 17/01* (2013.01); *E21B 33/085* (2013.01); *E21B 33/064* (2013.01)

(58) Field of Classification Search
CPC ..... E21B 23/01; E21B 17/01; E21B 33/085; E21B 33/064
(Continued)

(56) References Cited

U.S. PATENT DOCUMENTS 6,443,240 B1 9/2002 Scott
6,470,975 B1 10/2002 Bourgoyne et al.
(Continued)

FOREIGN PATENT DOCUMENTS

WO 9949173 9/1999
WO 0179654 10/2001
WO 2013006963 A1 1/2013

OTHER PUBLICATIONS

Australian Examination Report dated Mar. 31, 2017 for AU Patent Application No. 2015274199, 4 pages.
(Continued)

*Primary Examiner* — Anna M Momper
*Assistant Examiner* — Patrick F Lambe
(74) *Attorney, Agent, or Firm* — Smith IP Services, P.C.

(57) ABSTRACT

A riser pipe system for releasably securing a rotating flow control device internally within a riser string for use in offshore drilling can include a riser pipe section, a removable latch assembly for releasably securing the RFCD, and optionally, a removable seal assembly for sealing against the RFCD. The latch and seal assemblies are disposed within the riser pipe section and axially restrained by at least one removable retaining member. The latch assembly and seal assembly may be hydraulically or pneumatically actuated together or separately.

16 Claims, 6 Drawing Sheets

(51) Int. Cl.
*E21B 17/01* (2006.01)
*E21B 33/064* (2006.01)

(58) Field of Classification Search
USPC ..... 166/367
See application file for complete search history.

(56) References Cited

U.S. PATENT DOCUMENTS

| | | | | |
|---|---|---|---|---|
| 8,322,432 | B2 | 12/2012 | Bailey et al. | |
| 8,985,229 | B2 | 3/2015 | Edvardsen et al. | |
| 2003/0106712 | A1 | 6/2003 | Bourgoyne et al. | |
| 2006/0102387 | A1 | 5/2006 | Bourgoyne et al. | |
| 2008/0105434 | A1 | 5/2008 | Orbell et al. | |
| 2009/0139724 | A1 | 6/2009 | Gray et al. | |
| 2010/0008190 | A1 | 1/2010 | Gray et al. | |
| 2010/0175882 | A1 | 7/2010 | Boyd | |
| 2011/0024195 | A1 | 2/2011 | Hoyer et al. | |
| 2012/0000664 | A1* | 1/2012 | Nas | E21B 33/085 166/344 |
| 2012/0043726 | A1 | 2/2012 | Zubia et al. | |
| 2012/0055677 | A1 | 3/2012 | Boyd | |
| 2012/0085545 | A1 | 4/2012 | Tarique et al. | |
| 2013/0020068 | A1 | 1/2013 | Boyd | |
| 2013/0233556 | A1 | 9/2013 | Boyd | |
| 2014/0069720 | A1 | 3/2014 | Gray | |
| 2014/0238686 | A1 | 8/2014 | Boyd | |
| 2014/0318768 | A1 | 10/2014 | Boyd | |
| 2014/0318772 | A1 | 10/2014 | Boyd | |
| 2015/0007979 | A1 | 1/2015 | Boyd | |
| 2015/0021045 | A1 | 1/2015 | Boyd | |

OTHER PUBLICATIONS

Office Action dated Mar. 27, 2015 for U.S. Appl. No. 14/232,512, 9 pages.
International Search Report with Written Opinion dated Aug. 25, 2015 for PCT Patent Application No. PCT/CA2015/050527, 10 pages.
Office Action dated Dec. 4, 2015 for U.S. Appl. No. 14/232,512, 18 pages.
Notice of Allowance dated Mar. 30, 2016 for U.S. Appl. No. 14/232,512, 6 pages.
Canadian Office Action dated Oct. 21, 2016 for CA Patent Application No. 2,853,642, 4 pages.
Schlumberger; Oilfield Glossary; Riser; www.glossary.oilfield.slb.com; Jun. 27, 2011, 1 page.
Schlumberger; Oilfield Glossary; www.glossary.oilfield.slb.com; Jun. 27, 2011, 1 page.
Outline of Riser Drilling; www.jamstec.go.jp; Newsletter vol. 15; Jun. 27, 2011, 1 page.
Examination Report dated Sep. 5, 2017 for AU Patent Application No. 2015274199, 4 pages.
European Search Report dated Oct. 26, 2017 for EP Patent Application No. 15806275.2, 8 pages.
Canadian Office Action dated Oct. 26, 2017 for CA Patent Application No. 2,951,559, 3 pages.
Australian Examination Report dated Dec. 15, 2017 for AU Patent Application No. 2105274199, 3 pages.

* cited by examiner

RISER WITH INTERNAL ROTATING FLOW CONTROL DEVICE

CROSS-REFERENCE TO RELATED APPLICATIONS

This application is a national stage under 35 USC 371 of International Application No. PCT/CA2015/050527 filed on 9 Jun. 2015, which claims the benefit of the filing date of U.S. Application No. 62/009,501 filed on 9 Jun. 2014. The entire disclosures of these prior applications are incorporated herein by this reference.

FIELD OF THE INVENTION

The present invention relates to devices for managing downhole fluid pressures in offshore drilling, and more particularly to a riser pipe section with an internal rotating flow control device.

BACKGROUND TO THE INVENTION

Oil and gas offshore drilling operations require the use of a riser or riser string as it is also known. The riser consists of a string of pipe that extends from a floating drilling platform down to the sea floor. The riser is comprised of riser components that are attached end-to-end by means of flanged or custom connections. Drilling mud, cuttings and hydrocarbon products from the borehole in the seafloor are returned to the drilling platform through the riser. The top of the riser is attached to the drilling platform while its lower end is secured to the wellhead on the seafloor. Immediately below the drilling platform, the riser has a slip joint, or tension joint as it is also known, that is configured to telescope to compensate for the heave and swell that the floating drilling platform experiences in the sea.

It is conventional to use a subsurface blowout preventer (a "BOP") placed between the wellhead and the riser to provide protection against the sudden release of gas, which can arise if the drilling operations encounter pressurized formations. To promote safety and control, a surface BOP is also frequently placed at the top of the riser proximate to the drilling platform.

It is also conventional to use a surface rotating flow control device (a "RFCD") at the level of the drilling platform in conjunction with the surface BOP. The surface RFCD serves multiple purposes including the provision of a pressure seal around drill pipe that is being moved in and out of the riser and the wellbore while allowing rotation of same. Conventional diverters are also placed at the head of the riser above the slip joint to divert wellbore returns to the surface separation and storage equipment.

While the use of a surface BOP and a surface RFCD provides a pressure seal and a barrier between the external environment and the wellbore returns, such a configuration can be problematic. If the subsurface BOP fails, or if there is a sudden release of gas or pressurized fluid into the riser for any other reason (for example, solution gas assuming gaseous form as it ascends the riser), control of the pressurized gas or fluid in the riser occurs at the level of the drilling platform using the surface BOP stack, the surface RFCD and the diverter. This can result in exposure of the drilling platform to dangerous risk if the pressure and volume of the wellbore return within the riser exceeds the pressure rating of the riser, or if the capacity of the surface equipment to deal with this type of event is not adequate.

These problems may be mitigated by positioning the RFCD in the riser below the slip joint, which is typically the weakest pressure rated assembly in the riser string. In this manner, the RFCD creates a pressure seal that isolates the pressurized wellbore returns in the riser below the drilling platform so that they can be contained and diverted if required at a subsurface level thereby substantially eliminating the exposure of the drilling platform to danger, and giving the riser greater than typical pressure integrity.

U.S. 2006/0102387 to Bourgoyne et al, describes a RFCD releasably positioned in a riser by a holding member that is threaded to the RFCD. In use, the assembled holding member and RFCD are run down the riser together, until their movement is resisted either by lugs on the holding member that engage an internal shoulder of the riser, or a passive latching mechanism between the holding member and an internal formation of the riser. The holding member adds weight to the drill string, and a retractable seal is required between the holding member and the interior of the riser to permit passage of the holding member.

WO 2013006963 to Boyd et al, describes a RFCD integrated into the riser by a stationary housing having a flanged connector that is, in use, sandwiched between the flanges of two adjacent riser pipe sections. However, the flange connection of the stationary housing must be made complementary to the flanges of the adjacent riser pipe sections.

Accordingly, there is a need for a system to secure a RFCD in a riser to create an additional pressure seal between the wellbore and the external environment, which provide an alternative to the prior art, which may mitigate some of the difficulties of the prior art.

SUMMARY OF THE INVENTION

In one aspect, the present invention provides a system for securing a rotating flow control device ("RFCD") that forms a pressure seal around a drill pipe in a riser, with the drill pipe defining an axial direction parallel to its length and a radial direction perpendicular thereto.

In one aspect, the invention may comprise a system adapted to be installed axially within a riser string, and comprising:

(a) a riser pipe section configured to form part of the riser string;

(b) a latch assembly removably secured within the riser pipe section, wherein said latch assembly comprises one or more radially moveable lock dogs for securing the RFCD.

The system may further comprise a seal assembly removably secured within the riser pipe section and comprising a circumferential seal element adapted to be compressed against the RFCD when actuated.

In one embodiment, the latch assembly and seal assembly are axially restrained within the riser pipe section by an integrally formed shoulder at one end, and a removable snap ring and a ring retaining member at the other end.

In one embodiment, the latch assembly defines a first port in fluid communication with an activation fluid chamber, and a fluid relief chamber in fluid communication with a second port, wherein the lock dogs are actuated to engage or disengage the RFCD by a differential in fluid pressure between the first and second ports of the fluid chamber. The the latch assembly may comprise a latch actuation piston slidably disposed within the latch assembly, wherein an upper portion of the latch actuation piston is exposed to the activation fluid chamber, and a lower portion of the latch actuation piston is exposed to the relief fluid chamber, the latch actuation piston comprising a linear cam for converting axial movement of the piston into radial movement of the lock dogs.

In one embodiment, the seal assembly defines a third port in fluid communication with a seal activation chamber, and a seal relief chamber in fluid communication with a fourth port, wherein the seal element is actuated by a differential in fluid pressure between the third port and the fourth port. The seal assembly may comprise a seal actuation piston slidably disposed within the seal assembly, wherein an upper portion of the seal actuation piston is exposed to the seal activation chamber, and a lower portion of the seal actuation piston is exposed to the seal relief chamber, the seal actuation piston comprising a linear cam for converting axial movement of the piston into a compressive force of the seal element on the RFCD.

The system may comprise at least two seal assemblies, vertically assembled within the riser pipe section. In one embodiment, the at least two seal assemblies are disposed above and below the latch assembly respectively.

In one embodiment, the system may further comprise a collet locating member defining an internal profile and land which engages a collet disposed on the exterior of the RFCD to prevent downward movement of the RFCD, but allow upward movement of the RFCD. The collet locating member may be axially spaced from the latch assembly and the seal assembly such that when the RFCD collet engages the land, the latch assembly and the seal assembly are respectively aligned with circumferential latch and seal recesses defined on the RFCD.

In another aspect, the invention may comprise a rotating flow control device (RFCD) for providing a pressure seal around a drill pipe in a riser, the drill pipe defining an axial direction parallel to its length and a radial direction perpendicular thereto, the device being installable axially within a riser string by a system as described herein, the RFCD comprising:

(a) an outer housing and an inner tubular shaft axially rotatable within the outer housing, and a stripper element attached to the inner tubular shaft and adapted to sealingly grip the drill pipe; and (b) wherein the outer housing defines a circumferential groove for receiving at least one radially moveable lock dog.

In one embodiment, the outer housing further defines a second circumferential groove for receiving at least one radially moveable sealing member.

In one embodiment, the RFCD further comprises a collet having a plurality of collet fingers separated by axial kerfs, each finger having a fixed end and a free end having a upper chamfer and a lower chamfer.

In yet another aspect, the invention may comprise a method of securing a rotating flow control device ("RFCD") that forms a pressure seal around a drill pipe in a riser, the drill pipe defining an axial direction parallel to its length and a radial direction perpendicular thereto, the system being installable axially within a riser string, the method comprising the steps of:

(a) lowering the RFCD into a riser pipe section configured to form part of the riser string and having a removable latch assembly for releasably securing the RFCD with at least one lock dog; and (b) latching the latch assembly to the RFCD by hydraulically actuating the at least one lock dog to move radially to engage the RFCD.

In one embodiment, the method further comprises the step of sealing a seal assembly to the RFCD by hydraulically actuating at least one seal member to compress against the RFCD.

In one embodiment of the method, the RFCD comprises a collet and the riser pipe section comprises a collet locating member, wherein the RFCD is lowered until the collet engages the collet locating member. The RFCD may defines a latch receiving circumferential groove which is radially opposite the at least one lock dog when the collet engages the collet locating member.

Embodiments of the invention may avoid the need for components that add significantly to the weight of the drill string, retractable seals, and extensive modification to standard riser pipe sections. Further, embodiments of the system may allow the RFCD to be remotely secured and released.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. Any dimensions shown in the accompanying are intended to be illustrative only, and not limiting of the claimed invention. The drawings are briefly described as follows:

DETAILED DESCRIPTION OF EMBODIMENTS OF THE INVENTION

The invention relates to a system for securing a rotating flow control device ("RFCD") in a riser string of an offshore drilling operation.

Figure 1:
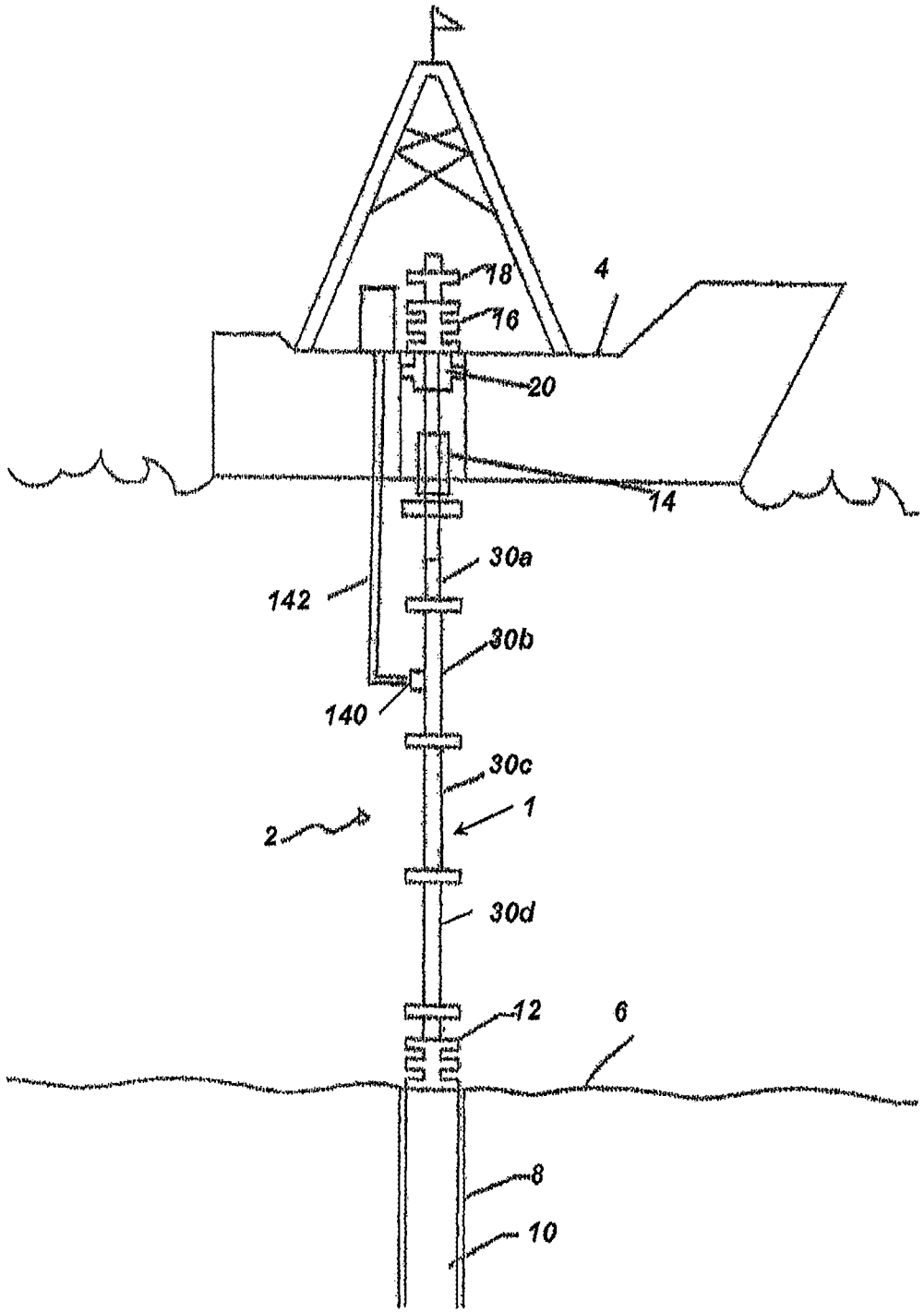
FIG. 1 is a diagrammatic depiction of one embodiment of an offshore drilling operation including a system of the present invention.

Offshore oil and gas drilling operations conducted on the sea floor require the use of a riser. In one embodiment, as shown in FIG. 1, the riser (2) extends from the drilling platform (4) down to the sea floor (6). The drilling platform (4) may comprise a floating rig or a drill ship, or any like surface platform employed by the offshore drilling industry. The riser (2) is comprised of a string of interconnected riser pipe sections (30*a*, 30*b*, 30*c*, 30*d*), generally denoted as (30). Commonly, the riser pipe sections (30) have flanged ends which are bolted together in conventional manner.

Once a wellbore (8) has been established in the sea floor (6) and a easing (10) has been cemented into place in the wellbore (8), a subsea BOP (12) is landed on and secured to the wellhead (not shown). The riser (2) connects to the subsurface BOP (12) and extends to the drilling platform (4). In practice, the subsurface BOP (12) is tested to ensure operational functionality following which, drilling operations commence through the riser (2). Drill pipe (not shown) is lowered down through the riser (2) and drilling mud is injected down through the drill pipe. Drilling mud, cuttings and hydrocarbon returns from the borehole travel up to the drilling platform (4) through the annular space between the drill pipe and the riser (2). Immediately below the drilling platform (4), the riser (2) has a slip joint (14) that is configured to telescope in an open and closed fashion to compensate for the heave and swell that the floating drilling platform (4) experiences in the sea. The slip joint (14) prevents the riser (2) from being pulled or pushed off the well head as the drilling platform (4) rises and falls with the movement of the sea.

As further shown in FIG. 1, a surface BOP (16) may be employed proximate to the drilling platform (4). It is also conventional to use a surface RFCD (18) at the head on the riser (2) on the drilling platform (4). The surface RFCD (18) serves multiple purposes including the provision of a pressure seal around tubular are being tripped in and out of the riser (2), and ultimately the wellbore (8) itself, while allowing rotation of the drill pipe. A conventional diverter (20) is also placed at the head of the riser (2) beneath the surface RFCD (16) to divert wellbore returns from the riser (2) to the surface separation and storage equipment (not shown).

The use of a conventional diverter (20) and a surface RFCD (18) at the head of a riser (2) provides a pressure seal and a barrier between the external environment and the wellbore returns. However, if the subsurface BOP stack (12) fails, or if there is a sudden release of gas or pressurized fluid into the riser (2) for any other reason (for example, solution gas assuming gaseous form as it ascends), control of the pressurized gas or fluid in the riser (2) occurs at the level of the drilling platform (4) using the surface BOP (16), the surface RFCD (18), and the diverter (20). This can expose the drilling platform (4) to dangerous risk if the pressure and volume of the wellbore return within the riser (2) exceeds the pressure rating of the riser (2), or if the capacity and pressure rating of the surface equipment to deal with this type of event is inadequate. For example, should the pressure in the riser (2) exceed the pressure capacity of its weakest component, which is typically a 500 psi maximum pressure rated slip joint (14) located immediately below the diverter (20) and drilling platform (4), then to preclude mechanical failure of the riser (2), the diverter (20) is usually configured to automatically open a control port to vent the wellbore returns to relieve pressure. This results in the sudden release of pressurized hydrocarbon product at surface level that can potentially ignite resulting in an explosion at surface. Further, if venting using the diverter (20) does not successfully reduce the pressure in the riser (2), mechanical failure in the riser (2) or the well head may occur, resulting in uncontrolled introduction of wellbore returns into the sea and external environment.

These problems may be mitigated by securing a RFCD in the riser (2) at a position below both the drill platform (4) and the weakest pressure rated assembly in the riser string, namely the slip joint (14), thus giving the riser (2) a much greater typical pressure integrity. In one embodiment, a riser (2) employing the system (1) of the present invention may have a pressure integrity of up to 2000 psi. When so secured, the combination of the system (1) and the RFCD create a pressure seal that Isolates the pressurized wellbore returns in the riser (2) below the drilling platform (4) such that it can be contained and diverted if required at a subsurface level thereby substantially reducing the exposure of the drilling platform to danger. In this manner, the system and the RFCD provide an effective additional safety system to complement the surface level conventional diverter (20), surface BOP (16), and the surface RFCD (18).

In one embodiment, the system (1) secures a RFCD (100) that forms a pressure seal around a drill pipe (200) in a riser (2), as is conventionally known. Suitable RFCDs are well known in the art, and may include those configurations described herein, or in co-pending applications U.S. patent application Ser. Nos. 13/702,476, 13/554,825, or 14/406,650, the entire contents of which are incorporated herein for all purposes. In general, the system (1) includes a riser pipe section (30), a lower retaining member (40), an upper retaining member (50), and a fastening assembly (60). In one embodiment, the system (1) also includes a collet locating member (130). As used herein, in describing the orientation of parts of the system (1), the term "axial" means a direction substantially parallel to the lengthwise direction of the drill pipe (200), and the term "radial" means a direction substantially perpendicular to the axial direction.

Figure 2:
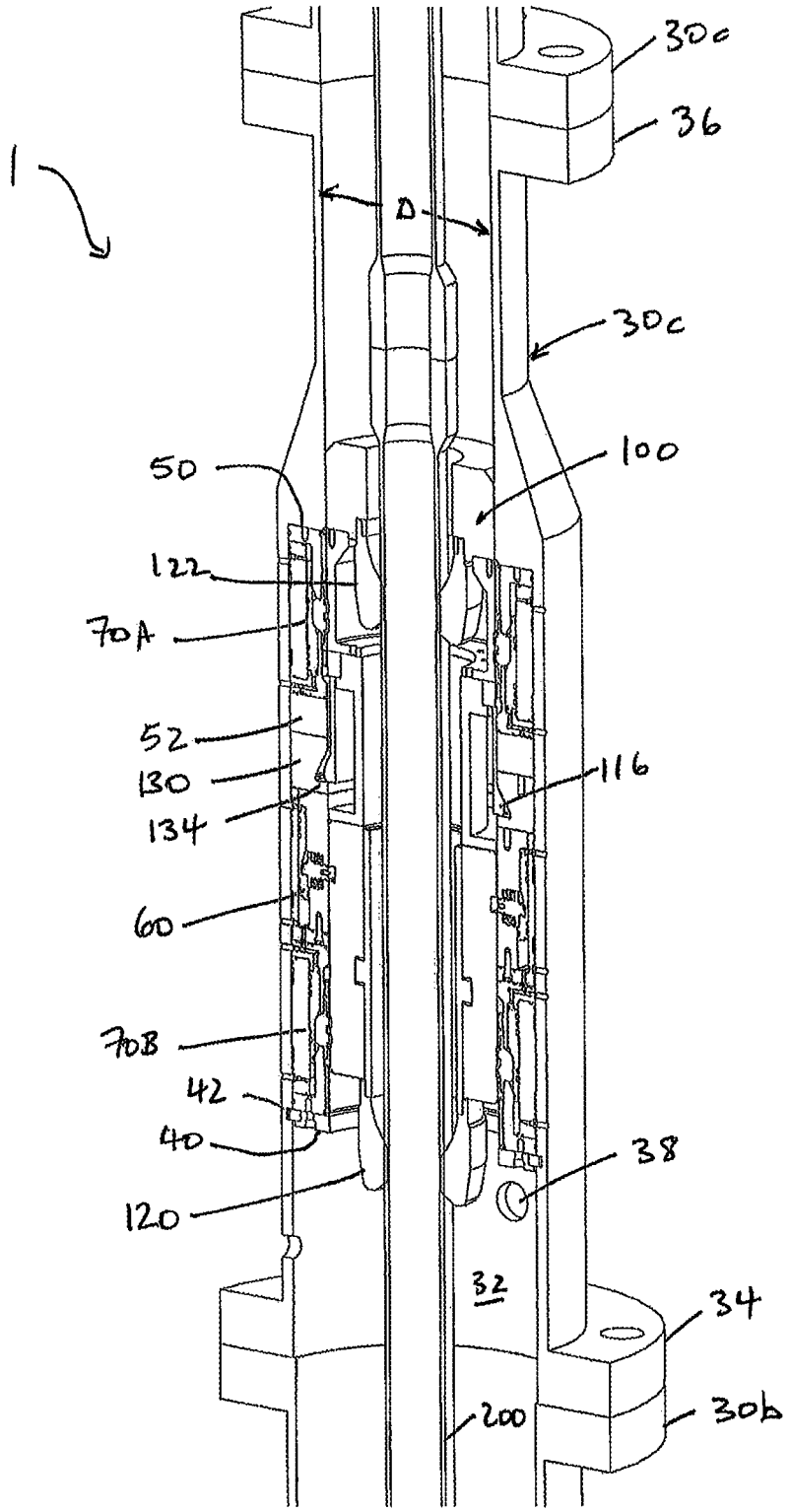
FIG. 2 is a three-dimensional perspective view through a vertical half-section one embodiment of the system of the present invention installed within a riser string, with a RFCD and drill pipe secured therein.
Figure 3:
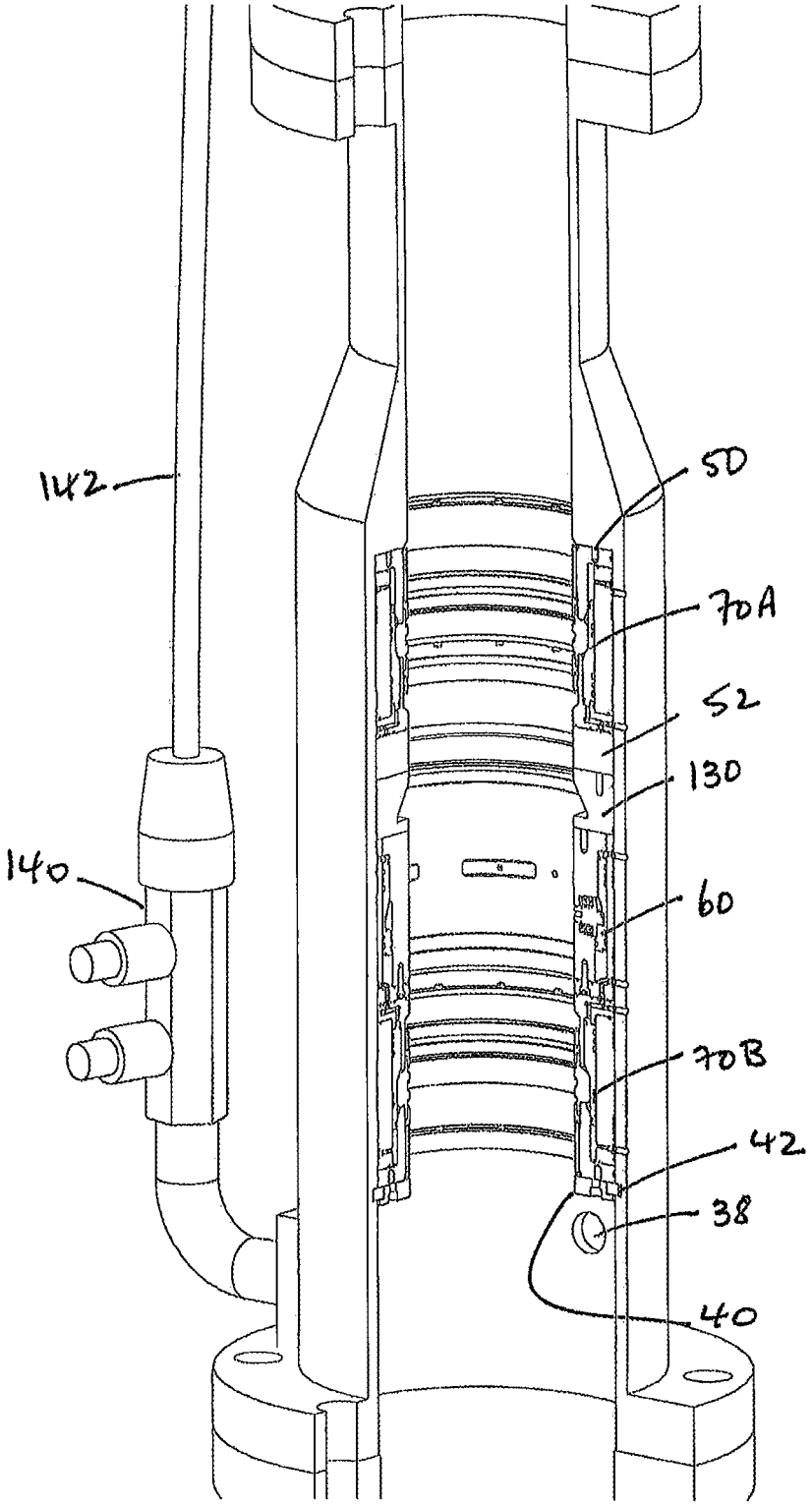
FIG. 3 is a three-dimensional perspective view through a vertical three-quarter section of the embodiment of the system shown in FIG. 2, with a flow outlet attached.

The riser pipe section (30) allows the system (1) to be installed axially within the riser string (2). Referring to FIG. 2, in one embodiment, the riser pipe section (30) has an inner wall (32) that defines a bore, which defines an annular space between the riser (2) and the drill pipe (200). The lower end of the riser pipe section (30) is formed into a flange (34) which is bolted to the upper flange of adjacent lower riser pipe section (30*b*). Similarly, the upper end of the riser pipe section (30) is formed into a flange (36) which is bolted to the lower flange of adjacent upper riser pipe section (30*d*). The flanges can be standard American Petroleum Institute (API) flanges or custom-sized to match flanges of riser components. In other embodiments (not shown), the lower and upper ends (34, 36) may comprise other types of connection systems employed in the art for rigidly connecting riser pipe components. Referring to FIG. 3, in one embodiment, the riser pipe section (30) also defines one or more ports (38) which can be used to relieve pressure downhole of the RFCD (100) in to an attached flow outlet (140), below the level of the RFCD (100).

The RFCD is secured within the riser pipe section (30) by at least one latch assembly (60), and optionally, at least one seal assembly (70). The embodiment shown in FIGS. 2 and 3 comprises a lock dog latch assembly (60), an upper seal assembly (70A), and a lower seal assembly (70B). The latch and seal assemblies (60, 70) are restrained at the upper end by a shoulder (50) formed by the riser pipe section (30) and at the lower end by a lower retaining member (40) and snap ring assembly (42). In one embodiment, a collet locating member (130) is disposed above the latch assembly (60) and below the upper seal assembly (70A). A spacer ring (52) may be provided above the collet locating member (130). The snap ring assembly (40) may be removed, allowing for disassembly of the latch and seal assemblies. In one embodiment, all fixed components of the latch and seal assemblies have an inner diameter that is substantially equal to the drift (i.e., internal diameter) (D) of the riser pipe section (30).

Figure 4:
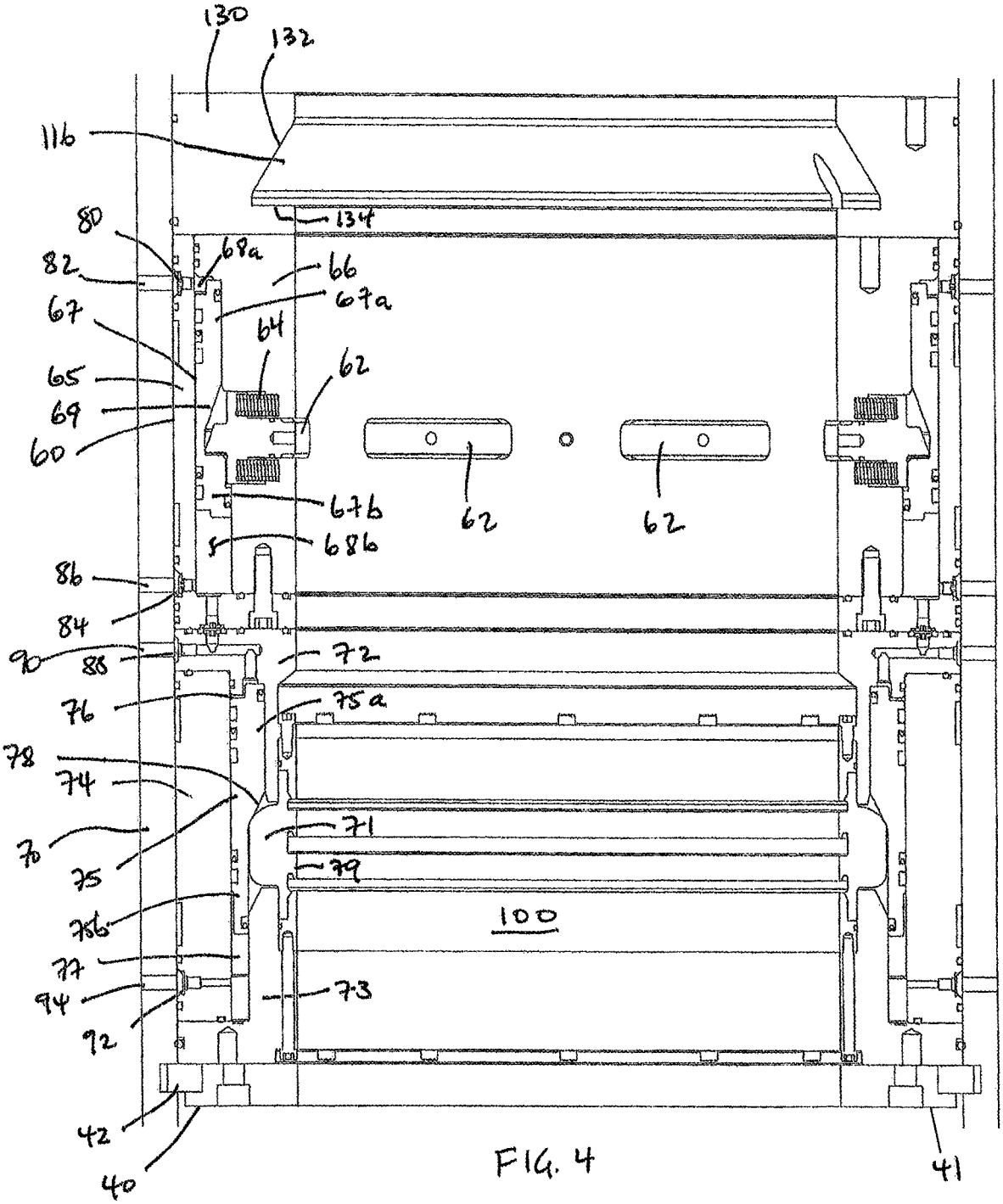
FIG. 4 is a side elevation view through a vertical half-section of a portion of the embodiment of the system shown in FIG. 2.

FIG. 4 shows the latch assembly (60) and the lower seal assembly (70B) which are bolted together. In one embodiment, a lower portion of the lower seal assembly (70B) is restrained by a snap ring (42) which has been sectioned into quarters to facilitate installation, each of which inserts into a groove formed in the inner wall of the riser pipe section and which protrudes inwardly to prevent downward movement of the seal assembly (70B). The snap ring segments (42) are then secured by bolting a lower retaining member (40) to the lower end of the seal assembly (70B). The lower retaining member (40) has a circumferential lip (41) which abuts the snap rings (42) and the inner wall of the riser pipe section (30). In alternatively embodiments, the lower retaining member (40) may be threaded to the riser pipe section or otherwise removably secured to the riser pipe section.

As may be appreciated by those skilled in the art, the orientation of the system (1) may be reversed such that the integrally formed internal shoulder (50) in the riser pipe section may be formed at a lower end, and the assembled retaining member (40) and snap ring (42) which allows disassembly and removal of the latch and seal assemblies may be provided at an upper end of the riser pipe section.

The latch assembly (60) is adapted to releasably secure the RFCD (100) within the riser pipe section (30) when the RFCD is positioned within the latch assembly (60). In one embodiment, the latch assembly (60) has an inner diameter that is substantially the same as the drift (D) of the riser pipe section (30). However, the latch assembly (60) includes a plurality of lock dogs (62) which may be extended radially inward to engage the RFCD (100), and which may be retracted to disengage from the RFCD (100) to allow for removal of the RFCD (100). When engaged, the lock dogs (62) also resist axial rotation of the RFCD (100) within the riser pipe section (30). In one embodiment, springs (64) bias the lock dogs (62) in the radial outward direction (disengaged), but yield when compressed.

The latch assembly (60) comprises an outer member (65) and an inner member (66), defining an annular space therebetween. A sliding latch piston (67) is disposed in the annular space and has an upper arm (67*a*) sealed to both the outer and inner members (65, 66) to form a sealed latch activation chamber (68*a*). A lower arm (67*b*) is similarly sealed to both the outer and inner members (65, 66) form a lower latch relief chamber (68*b*). An intermediate portion of the latch piston comprises a linear cam (69) which bears on the lock dogs (62) and translate axial motion of the latch piston into radial movement of the lock dogs.

Figure 5:
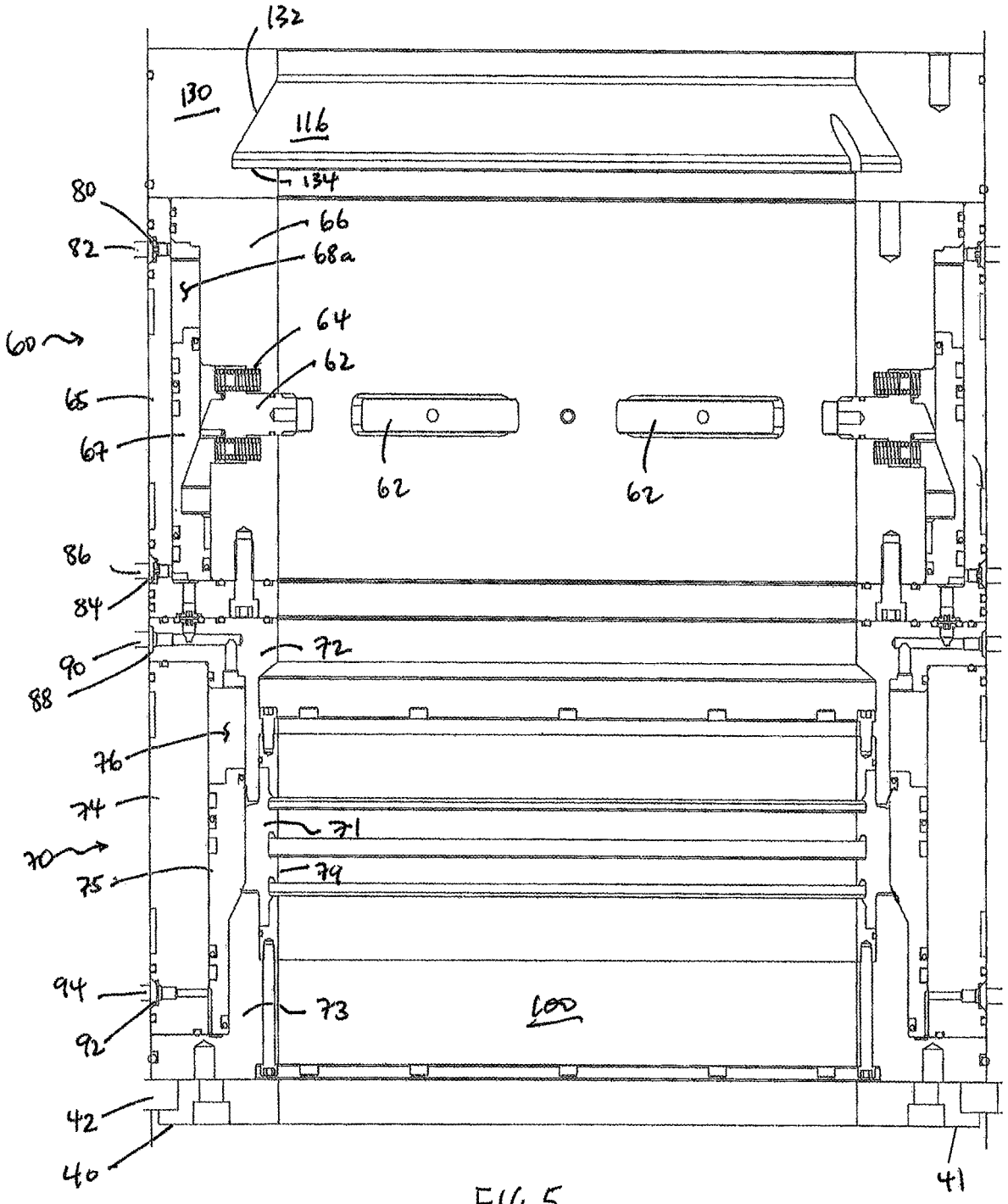
FIG. 5 is the same side elevation view of FIG. 4, with the latch assembly and the seal assembly in actuated positions.

A first port (80) in the outer member (65) coincides with port (82) in the riser pipe section (30), and is in fluid communication with the activation chamber (68*a*). A second port (84) coincides with port (86) in the riser pipe section and is in fluid communication with the lower hydraulic chamber (68*b*). If the fluid pressure in the activation chamber exceeds the fluid pressure in the lower chamber, then the latch piston (67) will be urged downwards, thereby actuating the lock dogs (62) by the linear cam (69), as shown in FIG. 5. Fluid in the lower chamber will be relieved out of ports (84) and (86). If the fluid pressure is reversed, the linear cam moves upwards, allowing retraction of the lock dogs, as is shown in FIG. 4.

Each seal assembly (70) provides a circumferential seal element (71) to sealingly engage the RFCD (100). The seal element (71) may be made of a compressible, flexibly resilient material, such as an elastomer, allowing for compression against the RFCD when actuated. The inner diameter of the seal element may closely match the outside diameter of an RFCD to be installed. In one embodiment, the inner face (79) of the seal element (71) comprises a seal profile which engages a corresponding dual seal recess (112) on the RFCD.

Each seal assembly comprises an upper member (72) and a lower member (73) which are spaced apart by the seal element (71), which is attached to the inner surfaces of both upper and lower members (72, 73). An outer member (74) is disposed between the upper and lower member to complete the seal assembly (70). A sliding seal piston (75) is disposed in the annular space between the outer member (74) and the upper and lower members. The seal piston (75) has an upper arm (75*a*) scaled to both the outer member (74) and upper member (72) to form a sealed seal activation chamber (76). A lower arm (75*b*) is similarly sealed to both the outer member (74) and lower member (73) to form a sealed seal relief chamber (77). An intermediate portion of the seal piston comprises a linear cam (78) which bears on the seal element (71) to compress it against the RFCD.

A third port (88) in the upper member (72) coincides with port (90) in the riser pipe section (30), and is in fluid communication with the seal activation chamber (76). A fourth port (92) through a lower portion of the outer member coincides with port (94) in the riser pipe section, and is in fluid communication with the seal lower chamber (77). If the fluid pressure in the seal activation chamber (76) exceeds the fluid pressure in the lower seal chamber (77), then the seal piston (75) will be urged downwards, thereby compressing the seal element (71) against the RFCD (100) by the linear cam (78). Fluid in the lower chamber will be relieved out of ports (92) and (94). If the fluid pressure is reversed, the linear cam moves upwards, relieving the compression of the seal element (71).

Figure 6:
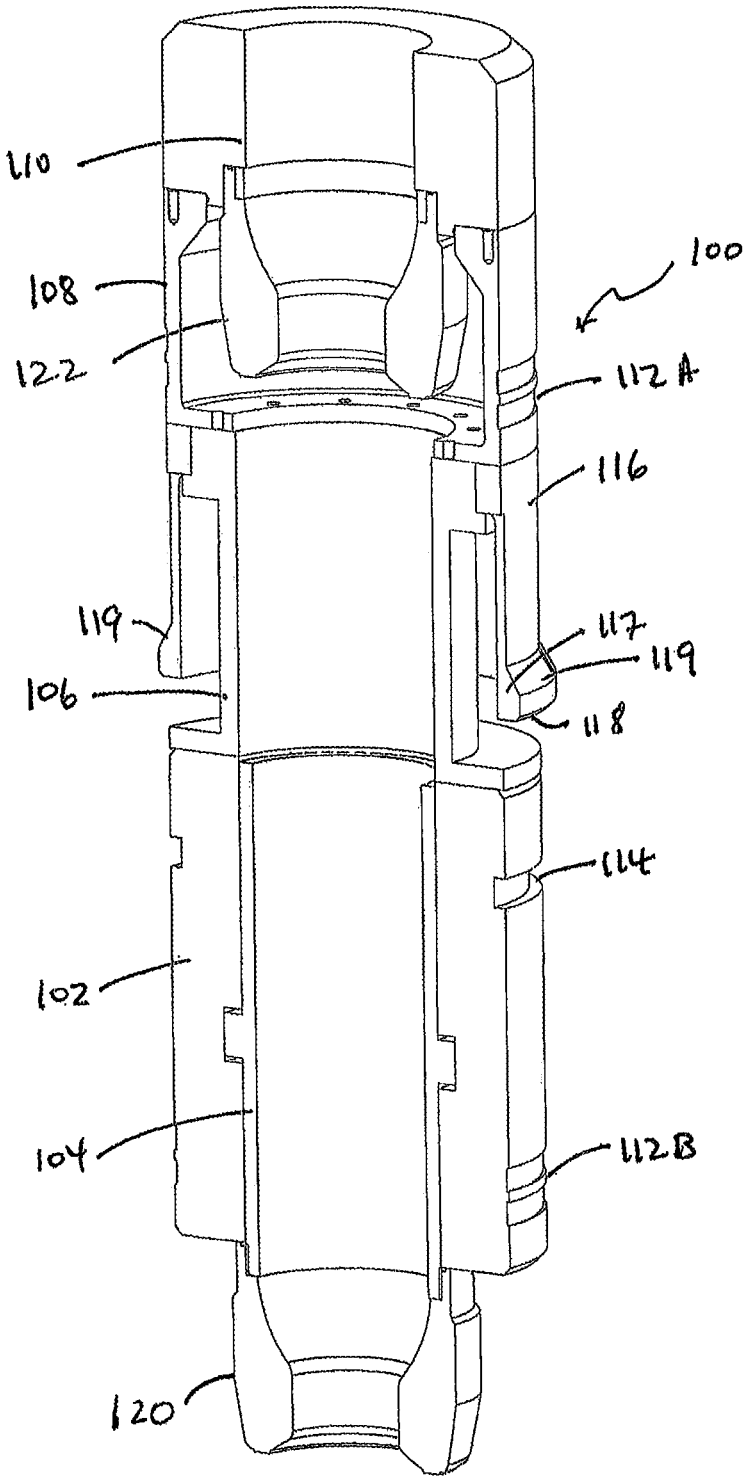
FIG. 6 is a three-dimensional perspective view through a vertical half-section of the embodiment of the RFCD shown in FIG. 2.

The conventional function of the removable RFCD (100) permits the drill pipe (200) to rotate within the riser pipe section (30) while providing a seal against the drill pipe using at least one stripper element. Referring to FIG. 6, in one embodiment, the lower outer housing (102) defines a circumferential lower seal recess (112B), a lock dog recess (114) and an upper seal recess (112A). The lower seal recess (112B) and the upper seal recess (112A) provides an engagement surface complementary in shape to the seal elements (71) of the lower and upper seal assemblies (70A, 70B) respectively, which creates a seal barrier when the seal elements (71) are actuated to engage and compress against the RFCD (100). The lock dog recess (114) is configured to receive the lock dogs (62) of the latch assembly (60).

Referring to FIG. 6, in one embodiment, the RFCD (100) is configured as a dual stripper arrangement. The RFCD (100) includes a lower housing (102) and a lower inner tubular shaft (104) for axial rotation therein. An intermediate housing (106) connects the lower outer housing (102) to a upper outer housing (108), which houses an upper inner tubular shaft (110) for axial rotation therein. The housings (102, 106, 108), and the tubular shafts (104, 110) may be constructed from any suitable metallic material including, without limit, 41/30 alloy steel. Each of the housings (102, 108) and their respective inner tubular shafts (104, 110) define therebetween an annular chamber (not shown) that contains bearing elements (not shown) and lubricating fluid. In one embodiment, the annular chambers may be sealed with respect to the lubricating fluid, thus avoiding the need for an external source of lubricating fluid and lubricating fluid lines. The bearing elements may comprise any suitable type used for like purposes by those skilled in the art, and may be arranged in any manner in the annular chambers to provide appropriate axial and radial support to the inner tubular shafts (104, 110). Any suitable lubricating fluid may be utilized in the annular chamber to cool and lubricate the bearing elements. Rotation of the inner tubular shafts (104, 110) within their respective outer housings (102, 108) is made possible by the bearing elements engaging an outer race that remains stationary with the housings (102, 108) and an inner race that rotates with the inner tubular shafts (104, 110).

The stripper elements (120, 122) sealingly grip the drill pipe (200) to create a fluid tight seal with the drill pipe (200)

and transfer axial rotation of the drill pipe (200) into axial rotation of the inner tubular shafts (104, 110) of the RFCD (100). Referring to FIG. 6, in one embodiment, a lower stripper element (120) is attached to the lower inner tubular shaft (104) and an upper stripper element (122) is attached to the upper inner tubular shaft (110) for a RFCD (100) with a dual stripper configuration. The stripper elements (120, 122) are well known in the art and may be constructed from any suitable rubber, elastomer, or polymer substance.

In one embodiment, the RFCD (100) comprises a collet (116) which cooperates with the collet locating member (130) in order to position the RFCD (100) within the riser pipe section (30) for engagement by the latch assembly (60) and the seal assemblies (70A, 70B). In one embodiment, the collet locating member (130) is an annular member formed separately and retained axially within the riser pipe section (30).

In one embodiment, the inner wall of the collet locating member (130) includes a vertical frustum-shaped surface (132) that terminates at the lower end with a horizontal annular land (134). The collet locating member (130) defines an inner diameter that is equal to the drift (i.e., internal diameter) (D) of the riser pipe section (30). Referring to FIG. 6, in one embodiment, the collet (116) is fixed by its upper end to intermediate housing (106) while its lower end is free to move radially. The collet (116) is a generally tubular member with a plurality of kerfs (not shown) cut in the axial direction to define a plurality of fingers (117) at its lower end. The collet preferably comprises spring steel or a similarly flexibly resilient high-strength material. In a relaxed state, the fingers define an outer diameter which is greater than the internal diameter of the riser pipe section (30) and the seal and latch assemblies. The fingers have a lower chamfer (118) which, when forced downwardly within the riser pipe section), compresses the fingers inward to allow the collet (116) and attached RFCD (100) to pass through the riser pipe section (30) and the upper seal assembly (70A). As the collet (116) continues to move downwards through the frustum-shaped surface (132) of the collet locating member (130), the fingers of the collet (116) are allowed to assume the relaxed shape, expanded radially outward, to engage the land (134), thus preventing further downward movement of the RFCD (100) as shown in FIG. 5. The collet (116) is dimensioned and positioned so that when it engages the land (134), the recesses (112A, 112B, 114) of the RFCD (100) are axially aligned with the upper and lower seal elements (71) and the lock dogs (62) of the latch assembly (60). The fingers also have an upper chamfer (119) which engages the frustum-shaped surface (132) when the RFCD (100) is pulled upward, thereby squeezing the fingers together and allowing the collet (116) to pass through the upper seal assembly (70A) and the riser pipe section (30).

The use and operation of the embodiment of the system (1) shown in FIG. 2 is now described. The latch assembly (60), the collet locating member (130) and the upper and lower seal assemblies (70A, 70B) and any intermediate or spacing members, may be assembled at the surface prior to installation in the riser string (2) and secured with the snap ring (42) and lower restraining member (40). Hydraulic or pneumatic fluid lines are connected to each of ports (82, 86, 90 and 94) of the riser pipe section (30). A dual valve flow outlet (140) (as shown in FIG. 3) for equalizing fill, and purge operations is connected to one of the ports (38). The flow outlet (140) is connected to pipes or hoses (142) (as shown in FIG. 1) which travel to the surface for the selective discharge of well fluids and gases. The valves in the flow outlet (140) may be opened and closed remotely using surface controls to facilitate the selective venting and diversion of the well bore returns. Once assembled in this manner, the riser pipe section (30) is installed into the riser (2) as a riser pipe section (30*c*) between adjacent riser pipe sections (30*b*, 30*d*) as shown in FIGS. 1 and 2.

The RFCD (100) is also assembled at the surface. When required, the drill pipe (200) is inserted through the stripper elements (120, 122). As shown in FIG. 2, the RFCD (100) may then ride the drill pipe (200) as the drill pipe (200) is lowered into the riser (2). Eventually, the collet (116) engages the land (134) of the collet locating member (130) to prevent further downward movement of the RFCD (100) when the recesses (112, 114) of the RFCD (100) are axially aligned with the seal element (71) of the seal assembly (70) and lock dogs (62) of the latch assembly (60) respectively. When the RFCD (100) is so positioned, hydraulic or pneumatic fluid is pumped through port (82) of the riser pipe section (30) into the activation chamber (68*a*) and fluid is relieved from the lower chamber (68*b*) through port (86) of the riser pipe section (30). This urges the lock dogs (62) into engagement with the recess (114) of the RFCD (100) to secure the RFCD (100) in place.

The seal assembly may be actuated at the same time, or previously or subsequently. Hydraulic or pneumatic fluid is pumped through port (90) into seal activation chamber (76), driving seal piston (75) downwards and compressing seal element (71) against the sealing recess (112) of the RFCD (100). Fluid is relieved from the lower seal chamber (77) through port (94) of the riser pipe section (30).

In one alternative embodiment, the relief port (86) of the latch assembly may be connected to the actuation port (90) of the seal assembly, thereby allowing synchronized actuation of the latch assembly and the seal assembly.

The RFCD (100) may be removed by reversing the foregoing steps. If the stripper elements (120, 122) are not too compromised, the RFCD (100) may be removed by pulling the drill pipe (200) upwards and the RFCD will ride the drill pipe (200) to the surface. However, if the stripper elements (120, 122) are unable to form an adequate seal on the drill pipe (200), then a recovery tool may be used for removal of the RFCD (100).

Once secured in the riser (2), the system (1) in conjunction with the RFCD (100) provides a seal on drill pipe (200) that is being run into or out of the wellbore (8) and provides an additional pressure barrier between the external environment and the wellbore (8) at a subsea level below the drilling platform (4). It also isolates the slip joint (14) from pressurized well bore returns. In the event of failure of the lower BOP stack (12) or the introduction of pressurized gas or fluid into the riser (2), the system (1) and RFCD (100) form a pressure seal thus precluding exposure of the slip joint (14) and the drilling platform (4) components to the pressurized fluid or gas. If venting is required to reduce the pressure in the riser (2) beneath the system (1), ports in the flow outlet (140) may be opened and the associated hose or pipe (142) will conduct the vented substances to a location that is a safe distance from the drilling platform. As such, the system (1) and RFCD (100) may be employed for well control operations, to promote safety and to mitigate environmental concerns and to manage high pressure drilling activities.

The description of the present invention has been presented for purposes of illustration and description, but it is not intended to be exhaustive or limited to the invention in the form disclosed. Many modifications and variations will be apparent to those of ordinary skill in the art without departing from the scope and spirit of the invention.

Embodiments were chosen and described in order to best explain the principles of the invention and the practical application, and to enable others of ordinary skill in the art to understand the invention for various embodiments with various modifications as are suited to the particular use contemplated.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such aspect, feature, structure, or characteristic with other embodiments, whether or not explicitly described. In other words, any element or feature may be combined with any other element or feature in different embodiments, unless there is an obvious or inherent incompatibility between the two, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

What is claimed is:

1. A system for securing a rotating flow control device ("RFCD") within a riser string, the system comprising:

a riser pipe section configured to connect in the riser string;

wherein the riser pipe section comprises a latch assembly, the latch assembly comprising at least one lock member which displaces radially inward and thereby secures the RFCD within the riser string;

wherein the riser pipe section comprises at least one seal assembly secured within the riser pipe section, the seal assembly comprising a circumferential seal element which seals radially inward against the RFCD when the seal assembly is actuated; and wherein the seal assembly comprises a seal actuation piston slidably disposed within the seal assembly, the seal actuation piston comprising a linear cam which converts axial movement of the piston into a compressive force of the seal element against the RFCD.

2. The system of claim 1, wherein the latch assembly and seal assembly are axially restrained within the riser pipe section by an integrally formed shoulder at one end, and a removable snap ring and a lower retaining member at an opposite end.

3. The system of claim 2, wherein the latch assembly comprises a first port in fluid communication with an activation fluid chamber, and a second port in fluid communication with a relief fluid chamber, wherein the latch assembly is actuated by a differential in fluid pressure between the first and second ports.

4. The system of claim 3, wherein the latch assembly comprises a latch actuation piston slidably disposed within the latch assembly, wherein an upper portion of the latch actuation piston is in pressure communication with the activation fluid chamber, and a lower portion of the latch actuation piston is in pressure communication with the relief fluid chamber, the latch actuation piston comprising a linear cam which converts axial movement of the piston into radial movement of the lock member.

5. The system of claim 1, wherein the seal assembly comprises a third port in fluid communication with a seal activation chamber, and a fourth port in fluid communication with a seal relief chamber, wherein the seal assembly is actuated by a differential in fluid pressure between the third port and the fourth port.

6. The system of claim 5, wherein an upper portion of the seal actuation piston is in pressure communication with the seal activation chamber, and a lower portion of the seal actuation piston is in pressure communication with the seal relief chamber.

7. The system of claim 1, comprising at least two seal assemblies, vertically spaced apart within the riser pipe section.

8. The system of claim 7, wherein a first seal assembly is positioned above the latch assembly and a second seal assembly is positioned below the latch assembly.

9. The system of claim 1, further comprising a collet locating member, wherein the collet locating member comprises a land which engages a collet disposed on an exterior of the RFCD, thereby preventing further downward movement of the RFCD, but allowing upward movement of the RFCD.

10. The system of claim 9, wherein the collet locating member is axially spaced from the latch assembly such that when the RFCD collet engages the land, the at least one lock member is aligned with a circumferential latch recess on the RFCD.

11. The system of claim 1, wherein the seal element comprises a sealing face having a profile comprising two circumferential sealing strips which engage two circumferential seal recesses on the RFCD.

12. A rotating flow control device (RFCD) for providing a pressure seal around a drill pipe in a riser, the rotating flow control device comprising:

an outer housing, wherein the outer housing is axially displaceable within the riser;

an inner tubular shaft axially rotatable within the outer housing;

a stripper element attached to the inner tubular shaft and adapted to sealingly grip the drill pipe;

wherein the outer housing comprises a circumferential groove which receives at least one radially moveable lock dog, and wherein the outer housing further comprises a second circumferential groove which receives at least one radially moveable sealing member.

13. The RFCD of claim 12, further comprising a collet having a plurality of collet fingers separated by axial kerfs, each finger having a fixed end and a free end having an upper chamfer and a lower chamfer.

14. A method of securing a rotating flow control device ("RFCD") in a riser string, the method comprising:

lowering the RFCD into a riser pipe section, wherein the RFCD comprises a collet and the riser pipe section comprises a collet locating member, and wherein the RFCD is lowered until the collet engages the collet locating member; and actuating a latch assembly, thereby displacing at least one lock dog radially inward to engage the RFCD.

15. The method of claim 14, further comprising actuating a seal assembly, thereby forming at least one seal between the riser pipe section and the RFCD, wherein the seal assembly comprises a circumferential seal element which seals radially inward against the RFCD when the seal assembly is actuated.

16. The method of claim 14, wherein the RFCD comprises a latch receiving groove which is axially aligned with the at least one lock dog when the collet engages the collet locating member.

* * * * *